US008535052B2

(12) United States Patent
Cadima

(10) Patent No.: US 8,535,052 B2
(45) Date of Patent: Sep. 17, 2013

(54) CAP FOR A GAS BURNER

(75) Inventor: Paul Bryan Cadima, Prospect, KY (US)

(73) Assignee: General Electric Company, Schenectady, NY (US)

( * ) Notice: Subject to any disclaimer, the term of this patent is extended or adjusted under 35 U.S.C. 154(b) by 1388 days.

(21) Appl. No.: 12/189,315

(22) Filed: Aug. 11, 2008

(65) Prior Publication Data

US 2010/0035197 A1 Feb. 11, 2010

(51) Int. Cl.

| | |
|---|---|
| ***F24C 15/14*** | (2006.01) |
| *F24C 15/08* | (2006.01) |
| *F23D 14/06* | (2006.01) |

(52) U.S. Cl.

USPC ..... 431/354; 431/119; 431/284; 99/425; 99/447; 126/214 R; 126/39 E; 126/39 N; 126/39 J; 239/12; 239/16; 239/17; D7/407; D7/408; D7/409; D12/207; D23/201; D23/415

(58) Field of Classification Search

CPC ..... F23D 14/76; F23D 14/06; F23D 14/02; F23D 14/20; F24C 3/08; F24C 3/085; F24C 7/081; F24C 15/14; F24C 15/36

USPC ..... 431/354, 119, 284; D7/407, 408, D7/409; 99/425, 447; 126/39 E, 39 H, 39 N, 126/39 J, 39 K; 239/12, 16, 17; D12/207; D23/201, 415

IPC ..... F24C 15/14; F23D 14/06

See application file for complete search history.

(56) References Cited

U.S. PATENT DOCUMENTS

| | | | | |
|---|---|---|---|---|
| 389,602 | A * | 9/1888 | Sankey | 99/445 |
| 1,030,118 | A * | 6/1912 | O'Neil | 126/52 |
| 1,256,243 | A * | 2/1918 | Maul | 239/556 |
| 1,457,371 | A * | 6/1923 | Kennedy | 239/557 |
| 1,650,359 | A * | 11/1927 | Huetteman et al. | 126/214 R |
| 1,651,714 | A * | 12/1927 | Kern | 239/17 |
| 1,703,115 | A * | 2/1929 | Lee | 126/39 R |
| 2,024,510 | A * | 12/1935 | Crisenberry | 239/402.5 |
| 2,298,307 | A * | 10/1942 | Parker | 126/39 H |
| 2,311,994 | A * | 2/1943 | Parker | 239/288.3 |
| 2,320,754 | A * | 6/1943 | Sherman | 126/39 K |
| 2,402,997 | A * | 7/1946 | Grayson | 236/33 |
| 2,640,531 | A * | 6/1953 | Lamar | 431/284 |
| 3,162,237 | A * | 12/1964 | Brown et al. | 126/39 R |
| 3,289,731 | A * | 12/1966 | Geber | 126/39 R |
| 3,568,927 | A * | 3/1971 | Scurlock | 239/17 |
| 3,713,583 | A * | 1/1973 | Gruber | 239/17 |

(Continued)

FOREIGN PATENT DOCUMENTS

| | | | |
|---|---|---|---|
| JP | 60011012 | A * | 1/1985 |
| JP | 02017309 | A * | 1/1990 |

(Continued)

*Primary Examiner* — Kang Hu
*Assistant Examiner* — Daniel E Namay
(74) *Attorney, Agent, or Firm* — Global Patent Operations; Douglas D. Zhang

(57) ABSTRACT

A cap for a gas burner is disclosed. The cap includes a center portion including a top surface having a periphery; at least one extension extending outward from the center portion, the at least one extension defining a drain channel extending outward and downward from the top surface; and a ledge extending along the periphery. A spill resistant gas burner assembly incorporating such a cap is also disclosed.

14 Claims, 6 Drawing Sheets

(56) References Cited

U.S. PATENT DOCUMENTS

| | | | | |
|---|---|---|---|---|
| 4,217,315 | A * | 8/1980 | Keeler, II | 261/120 |
| 4,372,290 | A * | 2/1983 | Visos et al. | 431/119 |
| D319,682 | S * | 9/1991 | Sharp et al. | D23/201 |
| 5,149,262 | A * | 9/1992 | Riehl | 431/258 |
| 5,277,576 | A * | 1/1994 | Hartung et al. | 431/198 |
| 5,954,492 | A * | 9/1999 | Lannes et al. | 431/177 |
| 6,092,518 | A * | 7/2000 | Dane | 126/214 D |
| D431,875 | S * | 10/2000 | Gutierrez | D26/57 |
| 6,146,132 | A * | 11/2000 | Harneit | 431/354 |
| 6,299,436 | B1 * | 10/2001 | Huang | 431/354 |
| 6,325,619 | B2 * | 12/2001 | Dane | 431/284 |
| 6,328,556 | B1 * | 12/2001 | Somer | 431/266 |
| 6,589,046 | B2 * | 7/2003 | Harneit | 431/266 |
| 6,604,519 | B1 * | 8/2003 | Bosser | 126/39 J |
| 6,655,954 | B2 * | 12/2003 | Dane | 431/354 |
| 6,851,420 | B2 * | 2/2005 | Jennings | 126/39 R |
| D520,102 | S * | 5/2006 | Harbaugh | D23/201 |
| 7,255,288 | B2 * | 8/2007 | Chan | 239/16 |
| 7,291,009 | B2 | 11/2007 | Kamal et al. | |
| D558,853 | S * | 1/2008 | Gu | D23/201 |
| 7,322,820 | B2 * | 1/2008 | Welton et al. | 431/354 |
| 7,614,877 | B2 * | 11/2009 | McCrorey et al. | 431/354 |
| 7,628,609 | B2 * | 12/2009 | Pryor et al. | 431/286 |
| 7,802,567 | B2 * | 9/2010 | Cadima et al. | 126/39 E |
| 7,878,800 | B2 * | 2/2011 | Bettinzoli | 431/354 |
| 2006/0121402 | A1 * | 6/2006 | Bettinzoli | 431/354 |
| 2007/0154858 | A1 | 7/2007 | Cadima | |

FOREIGN PATENT DOCUMENTS

| | | | |
|---|---|---|---|
| JP | 02017331 | A * | 1/1990 |
| JP | 02017332 | A * | 1/1990 |
| JP | 03144206 | A * | 6/1991 |
| JP | 03164611 | A * | 7/1991 |
| JP | 08200625 | A * | 8/1996 |
| JP | 09196325 | A * | 7/1997 |
| JP | 11118112 | A * | 4/1999 |
| JP | 11237010 | A * | 8/1999 |
| JP | 2001004108 | A * | 1/2001 |
| JP | 2001215023 | A * | 8/2001 |

* cited by examiner

CAP FOR A GAS BURNER

BACKGROUND OF THE INVENTION

The present invention relates generally to a cap for a gas burner. More particularly, the present invention relates to a cap for a gas burner, and a spill resistant gas burner assembly incorporating such a cap.

Gas burner assemblies have been widely used in cooking appliances such as free standing cooking ranges, cooktop units. Such gas burner assemblies often include a gas burner unit and a cap disposed on the gas burner unit. As is known in the art, included in the gas burner unit is an ignition system, such as, for example, a piezoelectric starter, that provides a spark for igniting gas flowing out of the gas discharge ports of the gas burner unit. Also as is known in the art, the cap can be made an integral part of the gas burner unit. Alternatively, it can be a removable part sitting on the gas burner unit. In the latter configuration, preferably the cap and the gas burner unit together define a plurality of gas discharge ports along a lateral wall of the gas burner unit (the cap defines the top of each gas discharge port). These are known in the art, and therefore will not be discussed in detail herein.

One common problem with gas burner assemblies is that liquids in a cooking vessel or utensil can be heated to such a degree that they may boil over from the top of the cooking vessel and fall onto the cap. Such boiled-over liquid, referred to as "spillover" or "spill" herein, can extinguish the flames of the gas burner unit and even foul the ignition system. In an attempt to prevent a relatively small amount of spillover from flowing into and extinguishing the flames, the cap often has a recessed portion on its top surface to confine the spillover therein. Alternatively and/or additionally, the cap often has a diameter that is slightly greater than that of the gas burner unit so that the cap can steer or direct the spillover away from the gas discharge ports of the gas burner unit.

While these caps may operate with some degrees of success, they have various disadvantages. For example, when a relatively large amount of spillover falls onto a known cap discussed above, flames are often extinguished. Moreover, despite efforts with known caps, spillover continues to foul the ignition system because of surface tension between the spillover and the cap as well as dynamics of the spillover.

A very large cap can be used to better shield the gas burner unit from spilled liquids. However, this large cap negatively impacts the combustion of the gas flowing out of the gas discharge ports because the flame has to travel almost horizontally a significant distance under the cap, thereby creating excessive flame impingement. It also reduces the heating efficiency of the gas burner assembly because a significant amount of the flame is below the cap and the heat is transferred to the cap rather than the cookware. FIG. 1 illustrates a side view of an exemplary gas burner assembly 100 wherein a large cap 110 is positioned on a gas burner unit 130. As illustrated in FIG. 1, flame 120 extends a significant distance under the cap 110 before being directed upward to heat a cooking utensil (not shown). This substantially reduces the heating efficiency of the gas burner assembly 100. Also shown is an igniter 140 that provides a spark for igniting the gas flowing out of the gas burner unit 130. As illustrated in FIG. 2, the cap 110 may be spaced high above the gas burner unit 130 by spacers 210. In this configuration, the combustion of the gas flowing out of the gas discharge ports may be improved. However, the cooking utensil is positioned further away from the flame 120'. As a result, the heating efficiency of the gas burner assembly 200 is again reduced.

Hence, there is a need in the industry for a cap which can safely steer or direct spillover away from the ignition system and the flame without substantially reducing the heating efficiency of the gas burner assembly.

BRIEF DESCRIPTION OF THE INVENTION

As described herein, the preferred embodiments of the present invention meet this and other needs and overcome one or more of the above or other disadvantages known in the art.

One aspect of the present invention relates to a cap for a gas burner. The cap includes a center portion including a top surface having a periphery; at least one extension extending outward from the center portion, the at least one extension defining a drain channel extending outward and downward from the top surface; and a ledge extending along the periphery.

Another aspect of the present invention relates to a spill resistant gas burner assembly. The assembly includes a gas burner, and a cap disposed above the gas burner. The cap includes a center portion including a top surface having a periphery; a plurality of extensions distributed along the periphery and extending outward therefrom, the extensions defining respective drain channels each extending outward and downward from the top surface; and a ledge extending along the periphery and between adjacent ones of the extensions.

These and other aspects and advantages of the preferred embodiments of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

The preferred embodiments shown in the accompanying drawings, and described in the accompanying detailed description, are to be used as illustrative embodiments and should not be construed as the only manner of practicing the invention. Also, the same reference numerals, possibly supplemented with reference characters where appropriate, have been used to identify similar elements.

Furthermore, it is to be understood that the figures and descriptions of the preferred embodiments of present invention have been simplified to illustrate elements that are relevant for a clear understanding of the present invention, while eliminating, for the purpose of clarity other elements found in conventional systems of the type described herein. Those of ordinary skill of the art may recognize that other elements and/or steps are desirable and/or required in implementing the present invention. However, because such elements and steps are well known in the art, and because they do not facilitate a better understanding of the present invention, a discussion of such elements and steps is not provided herein.

BRIEF DESCRIPTION OF THE DRAWINGS

In the drawings:

in FIG. 3C, part of a corresponding gas burner unit is also shown;

DETAILED DESCRIPTION OF THE PREFERRED EMBODIMENTS OF THE PRESENT INVENTION

FIGS. 3A-3D illustrate a bottom view, a perspective view, a first side view, and a second side view, respectively, of a cap 300 in accordance with an exemplary embodiment of the present invention.

Figure 1:
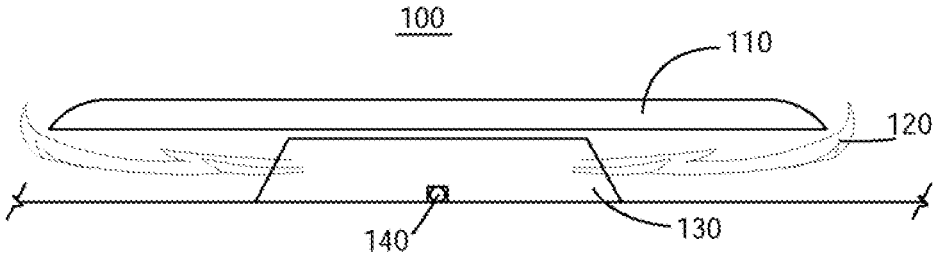
FIGS. 1 and 2 illustrate possible gas burner assembly configurations.
Figure 2:
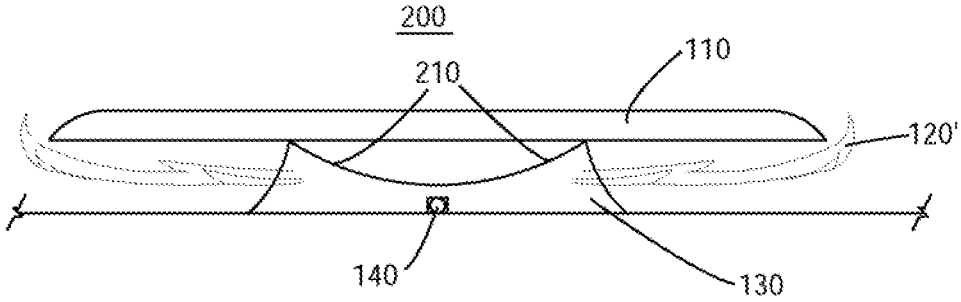
Figure 3A:
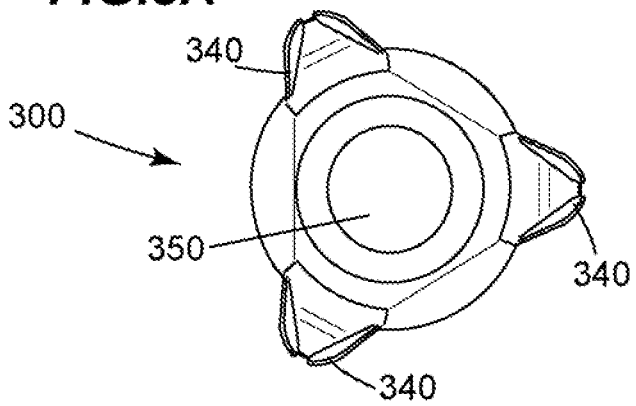
FIGS. 3A-3D illustrate a cap in accordance with an exemplary embodiment of the present invention.
Figure 3B:
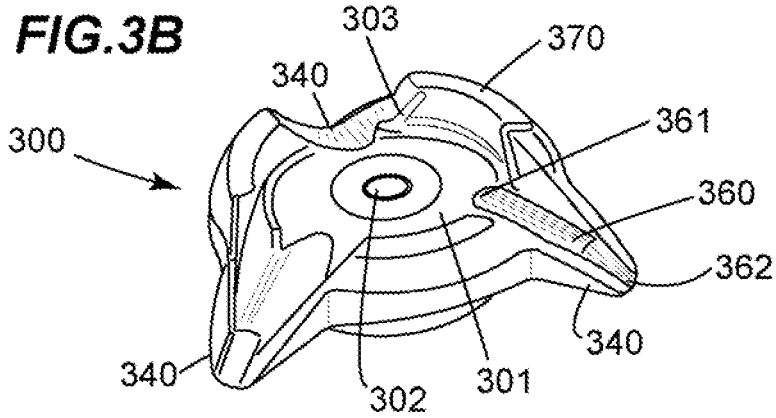

As shown in FIG. 3B, the cap 300 includes a substantially circular main or center portion 301 which has a top surface 302 with a periphery 303. Preferably three extensions or overhangs 340 extend outward and downward from the center portion 301. The extensions 340 are preferably substantially uniformly distributed along the periphery 303.

Each extension 340 defines therein a drain channel 360 which controls or directs the spilled liquids away from the top surface 302 of the center portion 301. More specifically, as illustrated in FIGS. 3B, 3C, 5 and 6, each drain channel 360 extends outward and downward from the top surface 302, with its upper end 361 being terminated at the top surface 302 and its lower end 362 being radially spaced apart from a gas burner unit 430. As clearly shown in FIGS. 5 and 6, each drain channel 360 has a main sloped surface 363, which preferably has a curved or substantially convex cross section. The center line of the main sloped surface 363 forms an acute angle A of at least 10 degrees with the top surface 302. The angle A is selected so that the gravitation forces on the spilled liquids are greater than the surface tension forces. Hence, the spilled liquids are likely directed away from the top surface 302 through the drain channel 360. In addition, each drain channel 360 preferably has a second sloped surface 364 extending further outward and downward from the lower end of the main sloped surface 363. Preferably the second sloped surface 364 also has a curved or substantially convex cross-section. The angle B formed by the center line of the second sloped surface 364 and the top surface 302 is preferably greater than the angle A. The lower end of the drain channel 360 terminates at the lower end of the respective extension 340.

Figure 3C:
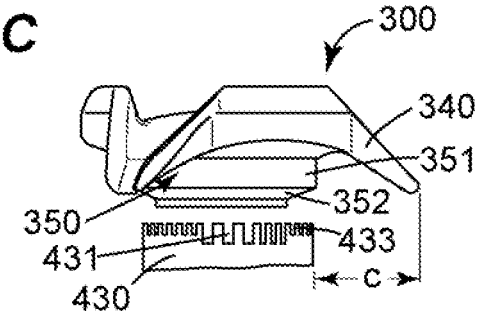
Figure 3D:
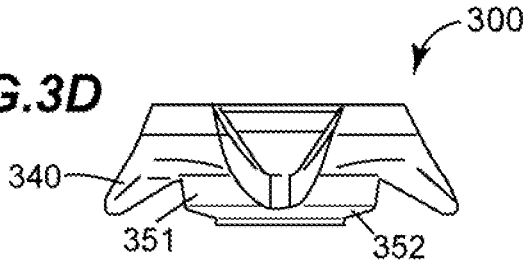
Figure 4A:
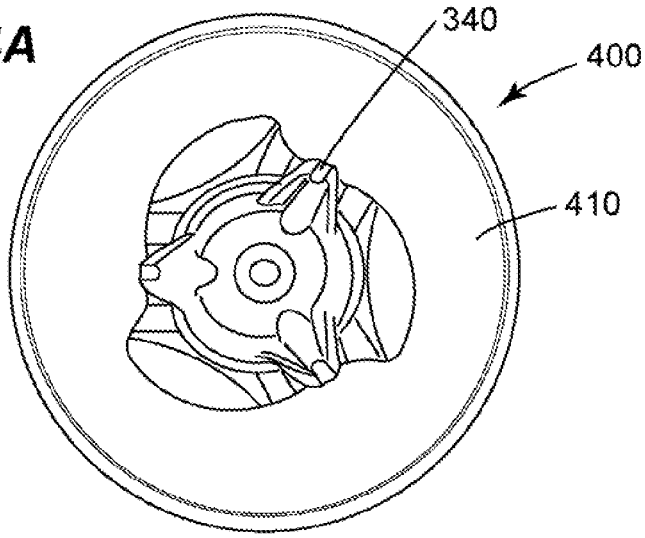
FIGS. 4A-4D illustrate an exemplary gas burner assembly incorporating the cap shown in FIGS. 3A-3D.
Figure 4B:
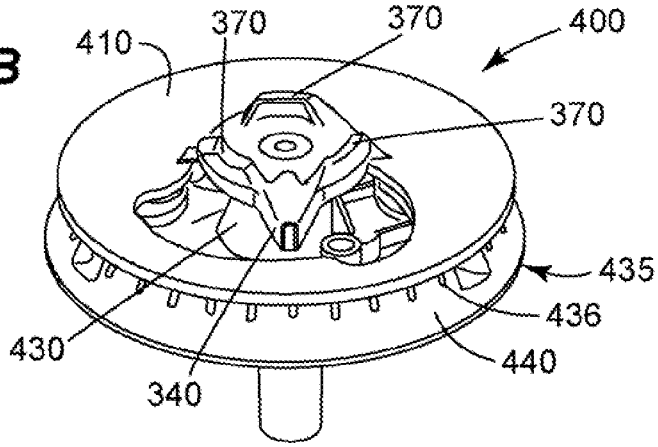
Figure 4C:
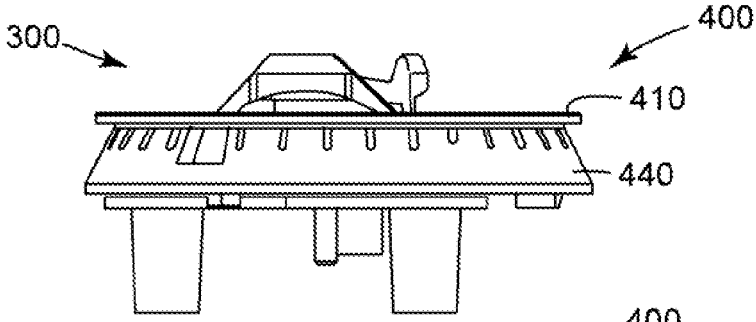
Figure 4D:
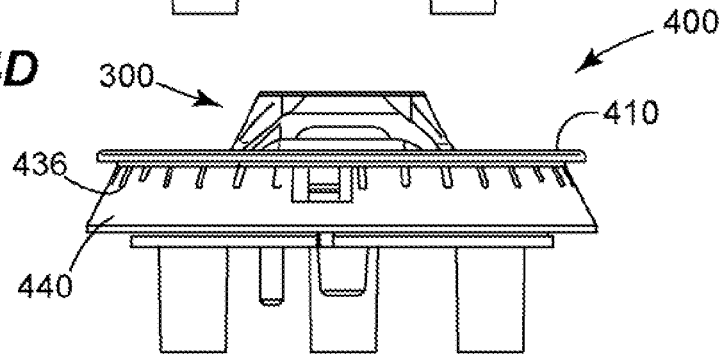

As shown in FIGS. 3A, 3C and 3D, the cap 300 also includes a substantially circular base portion 350 which extends downward from, and is preferably co-axial with, the center portion 310. Each extension 340 extends a predetermined distance from the base portion 350. In one exemplary embodiment, the main section 351 of the base portion 350 has a diameter which is slightly greater than that of the gas burner unit 430. The cap 300 can removably sit on the gas burner unit 430 with the lower, tapered end section 352 of the base portion 350 being received in the gas burner unit 430 in a manner known in the art. This configuration ensures that after installation, the radially inner most part of the underside of each extension 340 is spaced apart from the upper edge of the lateral wall of the gas burner unit 430 by the height of the main section 351. Moreover, preferably the outer or lower end of each extension 340 is radially spaced apart from the lateral wall of the gas burner unit 430 by a distance C of at least 0.3125 (5/16) inches (see FIG. 3C).

Extending upward from the center portion 301 along the periphery 303 are ledges 370 that enclose or surround the top surface 302 except for the areas where the extensions 340 engage or merge with the top surface 302. The ledges 370 act as reflectors to prevent spilled liquids flowing onto the cap 300 from flowing out of the top surface 302 through other areas of the top surface 302. That is, by retaining spilled liquids within the space defined by the ledges 370 and the top surface 302, the spilled liquids will likely be directed away from the top surface 302 in a controlled manner only through the drain channels 360.

Although the exemplary embodiment of the invention is shown with three drain channels 340, it would be recognized by those skilled in the art that the embodiment discussed herein is not limited to the illustrated number of drain channels, but rather may include any number of drain channels 340. In fact, the cap 300 can have just one drain channel 340. Such altering of the number of drain channels has been contemplated and considered to be within the scope of the invention claimed.

FIGS. 4A-4D illustrate a top view, a perspective view, a first side view, and a second side view, respectively, of a gas burner assembly 400 in accordance with an exemplary embodiment of the present invention. The gas burner assembly 400 incorporates the cap 300 shown in FIGS. 3A-3D. In this illustrated embodiment, the cap 300 is centered over the gas burner unit 430 and with respect to a substantially annularly shaped cover 410 for a substantially annularly shaped second gas burner unit 435 which surrounds the gas burner unit 430. The second gas burner unit 435 and its cover 410 are optional.

Figure 5:
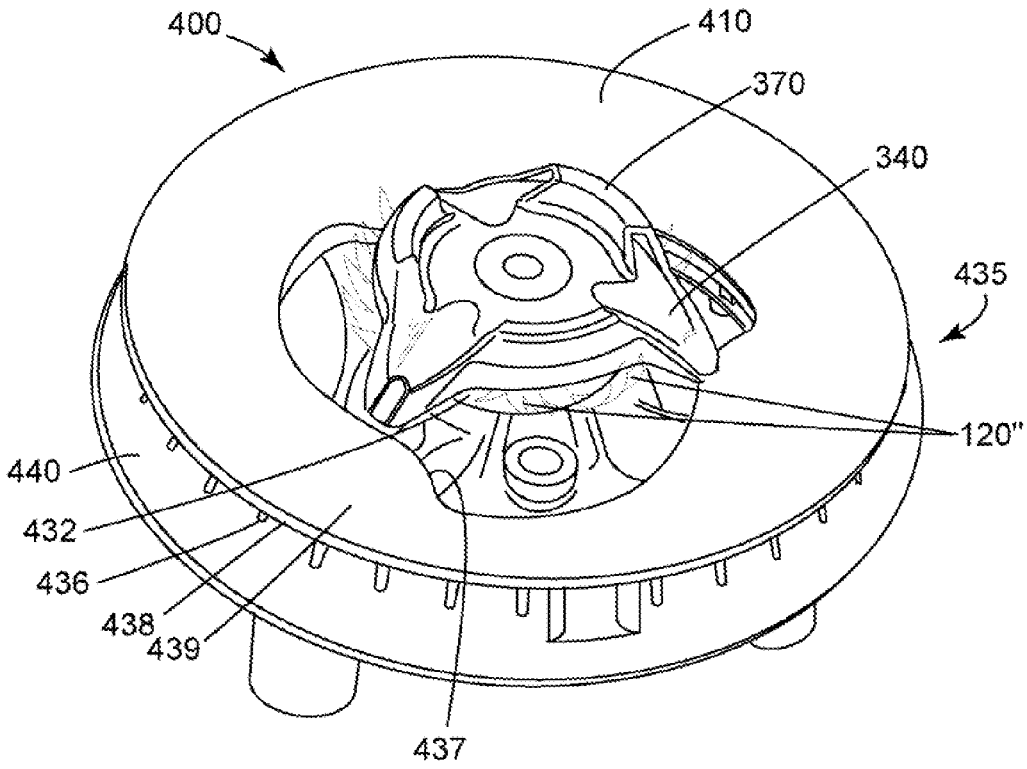
FIG. 5 is another perspective view of the gas burner assembly.
Figure 6:
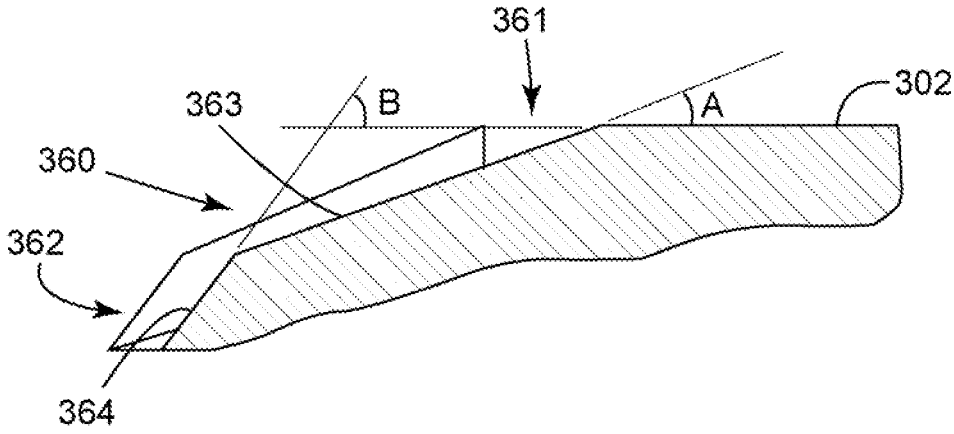
FIG. 6 is a cross-section view of an extension of the cap shown in FIGS. 3A-3D.
Figure 7:
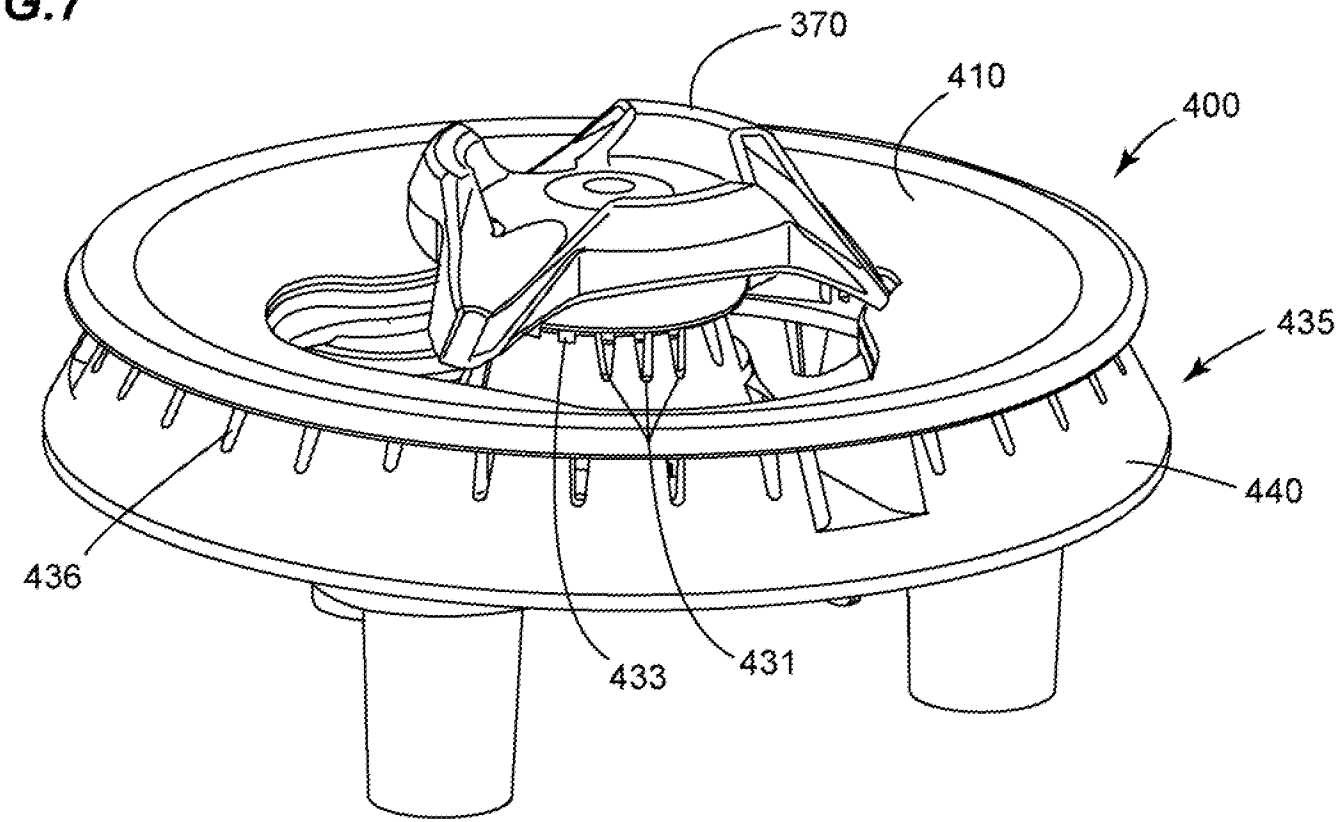
FIG. 7 is another perspective view of the gas burner assembly.

As shown in FIG. 5, during operation, flames 120" extend outward and upward from main gas discharge ports 431 formed on a lateral wall or periphery 432 of the gas burner unit 430. As discussed earlier, the ledges 370 extend only between the adjacent ones of the extensions 340. Thus, the lateral wall or periphery 432 of the gas burner unit 430 has portions that angledly correspond to, or vertically align with, the ledges 370. Preferably, the main gas discharge ports 431 are substantially uniformly distributed only along those portions. In other words, no main gas discharge ports 431 are formed on part of the lateral wall or periphery 432 that is vertically aligned with and here covered by the extensions 340. This configuration substantially avoids any undesired interference of the extensions 340 with the flames 120". However, as shown in FIG. 7, preferably carry-over ports 433 are formed on the part of the lateral wall or periphery 432 that is covered by the extensions 340 such that flames from the main gas discharge ports 431 on one side of an extension 340 are easily carried over to the main gas discharge ports 431 on the other side of the same extension 340 during the ignition process. The carry-over ports 433 are smaller than the main gas discharge ports 431. Moreover, preferably the carry-over ports 433 are substantially uniformly distributed only on the part of the lateral wall or periphery 432 covered by the extensions 340. Other than the main gas discharge ports 431 and the carry-over ports 433, the configuration of the gas burner unit 430 is similar to that known in the art, and therefore will not be discussed in detail here.

The configuration of the second gas burner unit 435 and the cover 410 is known in the art (see, for example, US Patent Application Publication No. 2007/0154858, the entire content of which is incorporated herein by reference), and the inner structure of the second gas burner unit 435 therefore will not be discussed here. As clearly shown in FIGS. 4B-4D and 5, the second gas burner unit 435 has a plurality of gas discharge ports 436 which are substantially evenly or uniformly distributed on a later wall 440 of the second gas burner unit 435. The cover 410 preferably removably sits on the second gas burner unit 435, and has an inner periphery 437, an outer periphery 438, and a curved top surface 439 extending inward and downward from the outer periphery 438 toward the inner periphery 437. The inner periphery 437 is disposed radially between the main gas discharge ports 431 of the first gas burner unit 430 and the gas discharge ports 436 of the second gas burner unit 435. As shown in FIG. 5, each extension 340 extends beyond the inner periphery 437, with its lower end thereof being disposed spaced apart from the top surface 439 of the cover 410 and between the inner periphery 437 and the outer periphery 438. Of course, if the second gas burner unit 435 is large enough, the lower end of each extension 340 can be disposed between the first gas burner unit 430 and the inner periphery 437 of the cover 410.

Each of the cap 300, the gas burner units 430, 435, and the cover 410 can be formed or made of a suitable material such as a metal.

Thus, while there has been shown, described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A spill resistant gas burner assembly comprising:

a first gas burner comprising a top; and a cap positioned on the first gas burner, the cap comprising:

a center portion comprising a top surface comprising a periphery, the top surface being spaced apart from the top of the first gas burner;

at least one extension extending outward from the center portion, the at least one extension defining a drain channel extending outward and downward from the top surface; and a ledge extending along the periphery;

a second gas burner surrounding the first gas burner and comprising a plurality of second main gas discharge ports; and a cover disposed on the second gas burner for covering the second main gas discharge ports, wherein the cover has a substantially annular shape comprising:

an inner periphery disposed between the first gas burner and the second gas burner;

an outer periphery; and a cover top surface extending inward and downward from the outer periphery toward the inner periphery, wherein the at least one extension extends beyond the inner periphery.

2. The spill resistant gas burner assembly of claim 1, wherein the at least one extension comprises an upper end which terminates at the center portion and a lower end which is spaced apart from the cover top surface.

3. The spill resistant gas burner assembly of claim 2, wherein the lower end is disposed between the inner periphery and the outer periphery.

4. The spill resistant gas burner assembly of claim 1, wherein the at least one extension comprises an upper end which terminates at the center portion and a lower end which is radially spaced apart from a lateral wall of the first gas burner by at least 5/16 inches.

5. The spill resistant gas burner assembly of claim 1, wherein the ledge is adjacent to the periphery.

6. The spill resistant gas burner assembly of claim 1, wherein the at least one extension comprises a plurality of extensions distributed along the periphery, the ledge extending between adjacent ones of the plurality of extensions.

7. The spill resistant gas burner assembly of claim 6, wherein the top surface is substantially circular, the plurality of extensions being substantially uniformly distributed along the periphery.

8. The spill resistant gas burner assembly of claim 1, wherein the drain channel extends outward and downward from the top surface at a predetermined angle.

9. The spill resistant gas burner assembly of claim 8, wherein the predetermined angle is at least 10 degrees.

10. The spill resistant gas burner assembly of claim 1, wherein the first gas burner comprises a lateral wall and a plurality of first main gas discharge ports on the lateral wall, the lateral wall comprising first portions vertically aligned with the ledge and second portions vertically aligned with the at least one extension, the plurality of first main gas discharge ports being distributed only in the first portions.

11. The spill resistant gas burner assembly of claim 10, wherein the plurality of first main gas discharge ports are substantially uniformly distributed along the first portions.

12. The spill resistant gas burner assembly of claim 10, wherein the first gas burner further comprises an igniter for igniting gas flowing out of the plurality of first main gas discharge ports.

13. The spill resistant gas burner assembly of claim 10, wherein the lateral wall comprises a plurality of carry-over ports which are distributed only in the second portions for carrying over flames from the plurality of first main gas discharge ports on a side of one of the at least one extension to the plurality of first main gas discharge ports on another side of the one of the at least one extension.

14. The spill resistant gas burner assembly of claim 13, wherein the carry-over ports are substantially uniformly distributed along the second portions.

* * * * *